US007455575B2

(12) United States Patent
Kim et al.

(10) Patent No.: US 7,455,575 B2
(45) Date of Patent: Nov. 25, 2008

(54) POLISHING PAD CLEANER AND CHEMICAL MECHANICAL POLISHING APPARATUS COMPRISING THE SAME

(75) Inventors: Jong-Bok Kim, Suwon-si (KR); Seung-Lyong Choi, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1 day.

(21) Appl. No.: 11/477,525

(22) Filed: Jun. 30, 2006

(65) Prior Publication Data

US 2007/0042691 A1 Feb. 22, 2007

(30) Foreign Application Priority Data

Aug. 16, 2005 (KR) ..... 2005-0074866

(51) Int. Cl.
*B24B 1/00* (2006.01)

(52) U.S. Cl. ..... 451/444; 451/41; 451/446

(58) Field of Classification Search ..... 451/444, 451/41, 28, 60, 37, 446, 56, 42
See application file for complete search history.

(56) References Cited

U.S. PATENT DOCUMENTS 5,558,564 A * 9/1996 Ascalon ..... 451/66
5,957,757 A * 9/1999 Berman ..... 451/56
6,273,790 B1 * 8/2001 Neese et al. ..... 451/38
6,284,092 B1 * 9/2001 Manfredi ..... 153/345.12
6,702,651 B2 3/2004 Tolles
7,014,552 B1 * 3/2006 Collier et al. ..... 452/56
2003/0199229 A1 * 10/2003 Vereen et al. ..... 451/36
2003/0216112 A1 11/2003 Gotze et al.

FOREIGN PATENT DOCUMENTS

KR 1020040051150 A 6/2004

* cited by examiner

*Primary Examiner*—Lee D Wilson
(74) *Attorney, Agent, or Firm*—Volentine & Whitt, PLLC

(57) ABSTRACT

A polishing pad cleaner of a chemical mechanical polishing apparatus throughly and efficiently cleans the polishing pad of the apparatus. The head of the polishing pad cleaner includes a nozzle support plate, a plurality of nozzles mounted to the nozzle support plate, and extending from the bottom of the nozzle support plate, and partitions interposed between the nozzles. The head is placed over the polishing pad. Subsequently, the polishing pad is roated relative to the nozzles, and cleaning agent is ejected from the nozzles. The partitions help maintain the pressure of the cleaning agent as the agent flows from the nozzles to the polishing pad. Also, different types of cleaning agents can be simultaneously ejected from the nozzles, respectively, onto the polishing pad. Specifically, a high pressure gas and a cleaning solution can be directed onto the same region of the pad one after the other.

10 Claims, 7 Drawing Sheets

POLISHING PAD CLEANER AND CHEMICAL MECHANICAL POLISHING APPARATUS COMPRISING THE SAME

BACKGROUND OF THE INVENTION

1. Field of the Invention

The present invention relates to a chemical mechanical polishing apparatus for use in the manufacturing of semiconductor devices and the like. More particularly, the present invention relates to a device for cleaning the polishing pad of a chemical mechanical polishing apparatus.

2. Description of the Related Art

A multi-layered interconnection technique is being widely used in the manufacturing of semiconductor devices to produce devices having greater integration densities. This technique produces multiple layers of interconnections on a surface of a substrate, and interlayer insulating layers interposed between the interconnection layers to insulate the interconnection layers from one another. The surface profile of an interlayer insulating layer directly affects the following process, such as a photolithography process used to form the next interconnection layer. Therefore, the interlayer insulating layer is preferably planarized over the entire surface of the substrate before the next process is carried out on the substrate.

The process that is currently most-widely used in planarizing a substrate is chemical mechanical polishing. Chemical mechanical polishing is performed by a polishing apparatus. FIG. 1 is a schematic view of a conventional chemical mechanical polishing apparatus.

Referring to FIG. 1, the polishing apparatus includes a polishing pad 3 mounted on a platen 1. The platen 1 is rotated by a rotary shaft 5. A polishing head 7 is disposed above the polishing pad 3. The polishing head 7 holds a semiconductor substrate 9 to its bottom, and is movable up and down. In the chemical mechanical polishing process, the polishing head 7 is lowered to place a layer of material on the substrate 9 in contact with the polishing pad 3 and the polishing pad 3 is rotated. Also, at this time, polishing slurry is provided on the polishing pad 3. The polishing slurry reacts with the layer of material on the substrate 9 to facilitate the chemical polishing of the layer.

Furthermore, the polishing pad 3 has a specific surface roughness in order to mechanically polish the layer on the substrate 9 as the polishing pad 3 is rotated relative to the substrate 9. However, the surface roughness of the polishing pad 3 decreases over time. Therefore, a polishing pad conditioner 11 is used to maintain the surface roughness of the polishing pad 3 by abrading the upper surface of the pad 3.

Therefore, the polishing pad conditioner 11 produces micro-debris during the polishing pad conditioning process. This debris begins to accumulate on the polishing pad 3. In addition, particles produced as the result of the polishing of the substrate also begin to accumulate on the polishing pad 3. As a result, the micro-debris and/or particles may alter the surface roughness of the polishing pad 3 or may remain present as foreign particles during the subsequent chemical mechanical polishing process. In particular, the polishing pad 3 has a plurality of pores 13 open at the upper surface of the polishing pad 3, and a plurality of concentric grooves 15 extending in the upper surface of the polishing pad 3. The pores 13 and grooves 15 receive the polishing slurry provided on the polishing pad and help distribute the slurry across the pad. The micro-debris produced during the polishing pad conditioning process and/or the particles produced as the result of the polishing process may become entrapped in the pores 3 and grooves 15.

Therefore, a polishing pad cleaner 17 is used to clean the polishing pad 3 of micro-debris, particles or excess polishing slurry. The polishing pad cleaner 17 is located at a predetermined position above the polishing pad 3. The polishing pad cleaner 17 includes one or more nozzles 19, and a cleaning solution supply pipe 21 connected to the nozzle(s) 19. A cleaning solution introduced through the cleaning solution supply pipe 21 is dispensed onto the polishing pad 3 under high pressure by the nozzle(s) 19. Typically, the cleaning solution is deionized water. In this case, the deionized water is ejected from the nozzle(s) 19 at a pressure of 4 $kgf/cm^2$ to force the micro-debris, particles or excess slurry off of the polishing pad 3.

However, when the polishing pad cleaner 17 has a plurality of nozzles 19, the streams of cleaning solution ejected from adjacent ones of the nozzles 19 can interfere with each other. In this case, the force under which the streams impinge the micro-debris, particles or excess slurry is reduced. Hence, the cleaning process is inefficient.

In addition, the cleaning process must be repeated several times to remove all of the micro-debris, particles and/or excess slurry. However, micro-debris, particles and/or excess slurry remaining on the polishing pad 3 after an initial cleaning process is performed bonds to the cleaning solution. That is, an aqueous membrane traps the micro-debris, particles and/or excess slurry on the surface of the polishing pad 3. The membrane impedes the cleaning of the polishing pad 3 during the next cleaning process. As a result, subsequent chemical mechanical polishing processes are not carried out with maximum efficiency and thus, the overall productivity of the semiconductor device manufacturing process is reduced.

SUMMARY OF THE INVENTION

An object of the present invention is to provide a polishing pad cleaner that can clean a polishing pad efficiently and/or thoroughly.

Likewise, another object of the present invention is to provide a chemical mechanical polishing apparatus having a rotating polishing pad, and a polishing pad cleaner that can clean the rotating polishing pad efficiently and/or thoroughly.

According to one aspect of the invention, a polishing pad cleaner includes a nozzle support plate, nozzles mounted to the nozzle support plate and projecting from the bottom of the nozzle support plate, and a respective partition interposed between adjacent ones of the nozzles.

According to yet another aspect of the invention, a chemical mechanical polishing apparatus has a rotatable platen, a polishing pad disposed on the rotatable platen so as to roate with the platen, and a polishing pad cleaner having a cleaning head that is supported in the apparatus so as to be movable to a cleaning position over the polishing pad, wherein the cleaning head includes a nozzle support plate, a plurality of nozzles mounted to the nozzle support plate and projecting from the bottom of the nozzle support plate, and a respective partition interposed between adjacent ones of the plurality of nozzles. The chemical mechanical polishing apparatus may further include a polishing head disposed above the polishing pad and to which a semiconductor substrate is held.

The nozzles of the polishing pad cleaner may be arranged in first and second groups each including at least one row of nozzles. The cleaner may also include first and second cleaning agent supply chambers in fluid communication with the first and second groups of nozzles, respectively. Furthermore, the cleaner may include first and second cleaning agent reservoirs connected to the first and second cleaning agent supply chambers, respectively, so that the first and second groups of nozzles may eject cleaning agents which are different from each other. For example, the first and second groups of nozzles may eject $N_2$ gas and deionized water, respectively. The cleaner may further include booster pumps disposed in-line between the nozzles and the cleaning agent reservoirs.

According to another aspect of the present invention, the spray axes of the nozzles are tilted with respect to the support plate. For example, the spray axes of the nozzles may be tilted toward the outer peripheral edge of the polishing pad when the head of the polishing pad cleaner is disposed at the cleaning position. Alternatively, the spray axes of the nozzles may be tilted in opposition to the direction of rotation the polishing pad when the head of the polishing pad cleaner is disposed at the cleaning position. Also, at least one of the partitions may lie in a plane parallel to the nozzles.

According to another aspect of the present invention, the polishing pad cleaner may include sidewalls extending along the outer peripheral edge of the nozzle support plate around the nozzles. At least one of the sidewalls may be tilted in opposition to the direction of rotation of the polishing pad when the head of the polishing pad cleaner is disposed at the cleaning position.

BRIEF DESCRIPTION OF THE DRAWINGS

The foregoing and other objects, features and advantages of the invention will be apparent from the more detailed description of the preferred embodiment of the invention, as illustrated in the accompanying drawings. Note, however, the drawings are not necessarily to scale. Instead, the emphasis of the drawings is on illustrating the principles of the invention. Also, like reference numerals designate like elements throughout the drawings.

DETAILED DESCRPTION OF THE PREFERRED EMBODIMENTS

Figure 1:
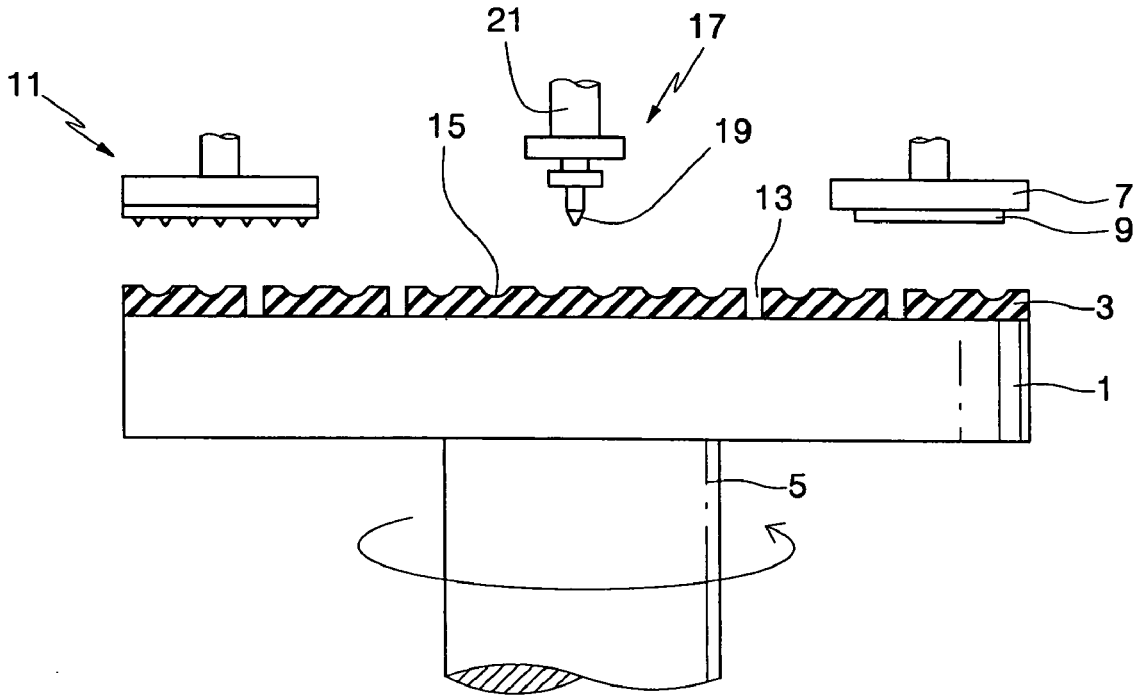
FIG. 1 (PRIOR ART)
FIG. 1 is a schematic diagram of a conventional chemical mechanical polishing apparatus having a polishing pad cleaner.
Figure 2:
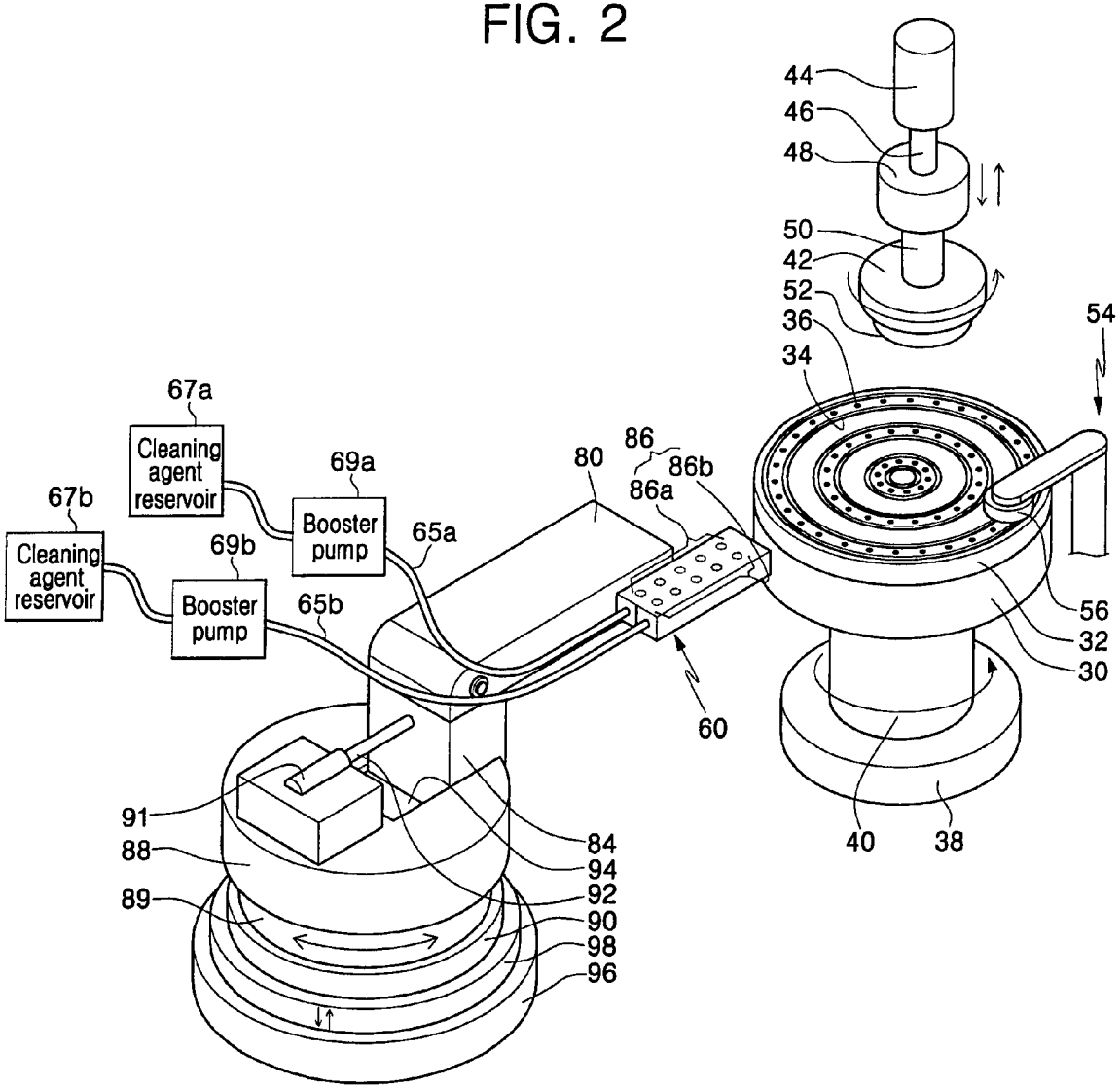
FIG. 2 is a schematic diagram of a chemical mechanical polishing apparatus having a polishing pad cleaner in accordance with the present invention.

The present invention will now be described more fully hereinafter with reference to FIGS. 2-5. Referring first to FIG. 2, a chemical mechanical polishing apparatus in accordance with the present invention includes a rotatable platen 30, a polishing pad 32 mounted on the rotatable platen 30, a polishing head 42 disposed above the polishing pad 32, a pad conditioner 54 disposed on the polishing pad 32, and a polishing pad cleaner 60.

The polishing pad 32 may be formed of polyurethane and is preferably porous. Also, the polishing pad 32 may be circular. In this case, the polishing pad 32 may have a plurality of concentric grooves 34 extending in the upper surface thereof, and a plurality of slurry holes 36 open at the upper surface. The grooves 34 and the pores 36 receive polishing slurry and help disperse the slurry across the upper surface of the polishing pad 32. A motor 38 is disposed under the rotatable platen 30. In addition, a rotary shaft 40 connects the rotatable platen 30 to the motor 38. The motor 38 rotates the rotating shaft 40 and thus rotates the rotatable platen 30 and the polishing pad 32.

A cylinder 44 supports the polishing head 42 above the polishing pad 32. The cylinder 44 may be a hydraulic cylinder or a pneumatic cylinder. More specifically, a piston rod 46 of the cylinder 44 is connected to the polishing head 42 to raise and lower the polishing head 42. In addition, a motor 48 is disposed between the cylinder 44 and the polishing head 42. Furthermore, a rotary shaft 50 is disposed between and connects the polishing head 42 and the motor 48 such that the rotary shaft 50 can rotate the polishing head 42. A semiconductor substrate 52 can be held to the bottom of the polishing head 42. To this end, the polishing head 42 may include a vacuum chuck which holds the substrate to the polishing head 42 using suction.

In order to polish the semiconductor substrate, polishing slurry is provided onto the polishing pad. Then, the polishing head 42, to which the substrate 52 is held, is lowered. Thus, the semiconductor substrate 52 is held in place between the polishing pad 32 and the polishing head 42. Then, the polishing pad 32 or the polishing head 42 is rotated to polish the semiconductor substrate 52. That is, the semiconductor substrate 52 is chemically and mechanically polished.

The pad conditioner 54 conditions the polishing pad 32 to maintain the efficacy of the polishing pad 32. In this respect, the pad conditioner 54 includes a disc 56. Diamonds are embedded in a surface of the disc 56. The diamonds may have a size (average diameter) of 100-200 μm. In the pad conditioning process, the disc 56 is placed against the upper surface of the polishing pad 32. Then, the polishing pad 32 is rotated. Also, pad conditioner 54 is moved horizontally across the polishing pad 32 during the polishing pad conditioning process. Accordingly, the entire upper surface of the polishing pad 32 is scored by the diamonds, whereby the pad is conditioned.

Referring to FIGS. 2 to 5, the polishing pad cleaner 60 cleans the polishing pad 32. The polishing pad cleaner 60 has a head that includes a generally rectangular cleaning agent supply chamber 62. The head of the polishing pad cleaner may be disposed above the polishing pad with cleaning agent supply chamber 62 extending longitudinally in a radial direction of the polishing pad 32. In addition, the length of the cleaning agent supply chamber 62 may correspond to the radius of the polishing pad 32. Also, the cleaning agent supply chamber 62 may be divided into first and second cleaning agent supply sub-chambers 62*a* and 62*b*, which are isolated from each other. For example, a separating plate 63 partitions the cleaning agent supply chamber 62 into sub-chambers 62*a* and 62*b* (referred to hereinafter merely as "chambers 62*a* and 62*b*").

Cleaning agent supply pipes 65*a* and 65*b* are connected to the cleaning agent supply chamber 62. A cleaning agent is introduced into the cleaning agent supply chamber 62 through each of the cleaning agent supply pipes 65*a* and 65*b*. The cleaning agent flowing through the cleaning agent supply pipe 65*a* may be different from the cleaning agent flowing through the cleaning agent supply pipe 65*b*. For example, the cleaning agent flowing through cleaning agent supply pipe 65*a* may be a cleaning solution, whereas the cleaning agent flowing through cleaning agent supply pipe 65*b* may be a cleaning gas. The cleaning solution may be deionized water, and the cleaning gas may be $N_2$.

Also, one cleaning agent supply pipe 65*a* is in fluid communication with the first cleaning agent supply sub-chamber 62*a*, and the other cleaning agent supply pipe 65*b* is in fluid communication with the second cleaning agent supply chamber 62*b*. As a result, different cleaning agents may be introduced into the first and second cleaning agent supply chambers 62*a* and 62*b*, respectively. That is, deionized water may be introduced into the first cleaning agent supply chamber 62*a*, and $N_2$ may be introduced into the second cleaning agent supply chamber 62*b*. In this case, the cleaning gas is ejected at a pressure higher than that of the cleaning solution because it is easier to pressurize gas, in general, e.g., the $N_2$, than liquid.

The cleaning agent supply pipes 65*a* and 65*b* are in fluid communication with cleaning agent reservoirs, respectively, such as a cleaning solution reservoir 67*a* for storing cleaning solution under high pressure and a cleaning gas reservoir 67*b* for storing cleaning gas under high pressure. Booster pumps 69*a* and 69*b* may disposed in-line with the cleaning agent supply pipes 65*a* and 65*b* to increase the pressure of the cleaning agents. The booster pumps 69*a* and 69*b* can facilitate an ejection of the cleaning solution at a pressure of about 6 kgf/cm$^2$ and an ejection of the cleaning gas at a pressure of 6 kgf/cm$^2$ or more.

The head of the polishing pad cleaner 60 also includes a plurality of nozzles 86 spaced from each other at the bottom of the cleaning agent supply chamber 62 and are each in fluid communication with the cleaning agent supply chamber 62. More specifically, the cleaning agent supply chamber 62 has a nozzle support plate 64 at the bottom thereof. The nozzles 86 are mounted to the bottom of the nozzle support plate 64. Openings in the nozzle support plate 64 place the nozzles 86 in fluid communication with the cleaning agent supply chamber 62. Thus, the cleaning agents are supplied under high pressure onto the surface of the polishing pad 32 through the nozzles 86 to clean the polishing pad.

The nozzles 86 may be arranged in first and second groups (rows) of nozzles 86*a* and 86*b*. The first group of nozzles 86*a* is disposed under the first cleaning agent supply chamber 62*a* in fluid communication therewith. Similarly, the second group of nozzles 86*b* is disposed under the second cleaning agent supply chamber 62*b* in fluid communication therewith. Therefore, the first and second groups of nozzles 86*a* and 86*b* eject different cleaning agents when different cleaning agents are supplied to the first and second cleaning agent supply chambers 62*a* and 62*b*, respectively. For example, the first group of nozzles 86*a* may eject $N_2$ gas, and the second groups of nozzles 86*b* may eject deionized water.

When the polishing pad 32 is cleaned the cleaning agent supply chamber 62 is disposed over the polishing pad 32 with the groups of nozzles 86*a*, 86*b* each aligned substantially in a radial direction of the polishing pad 32. Then, the polishing pad 32 is rotated. During this time, cleaning agents are ejected onto a surface of the polishing pad 32 through the nozzles 86. In particular, different cleaning agents are ejected onto different regions of the polishing pad 32 at the same time. Moreover, because the polishing pad 32 is rotated as the cleaning agents are ejected from the nozzles 86, one cleaning agent is first ejected onto a region of the rotating polishing pad, and then the other cleaning solution is ejected onto the same region.

However, an aqueous membrane entrapping particles and micro-debris may be formed on the polishing pad 32 after several cycles of the cleaning process. In this case, it is difficult to remove the particles or micro-debris using only a cleaning solution ejected onto the membrane under a specific pressure. In accordance with the present invention, though, cleaning gas can be ejected under high pressure as the polishing pad 32 is rotated. The aqueous membrane is removed from a particular region of the polishing pad 32 by the cleaning gas especially because the pressure of the cleaning gas is relatively high, i.e., is ejected at a pressure that is significantly higher than that at which a liquid cleaning solution alone can be ejected. Such a cleaning solution, on the other hand, is ejected onto the region of the polishing pad from which the aqueous membrane has been cleared by the cleaning gas. The cleaning solution, therefore, can remove the particles, micro-debris and/or excess slurry formerly covered by the aqueous membrane. Thus, the polishing pad 32 is thoroughly cleaned.

Although the polishing pad cleaner 60 has been described above as having two groups (rows) of nozzles 86*a*, 86*b*, the present invention is not so limited. For example, the nozzles 86 may be alternatively arranged in first to fourth groups (rows) of nozzles. In this case, the first and second groups (rows) of nozzles are installed under the first cleaning agent supply chamber 62*a*. Similarly, the third and fourth groups (rows) of nozzles are installed under the second agent supply chamber 62*b*. In addition, the first and second groups of nozzles may eject $N_2$, and the third and fourth groups of nozzles may eject deionized water.

Figure 3:
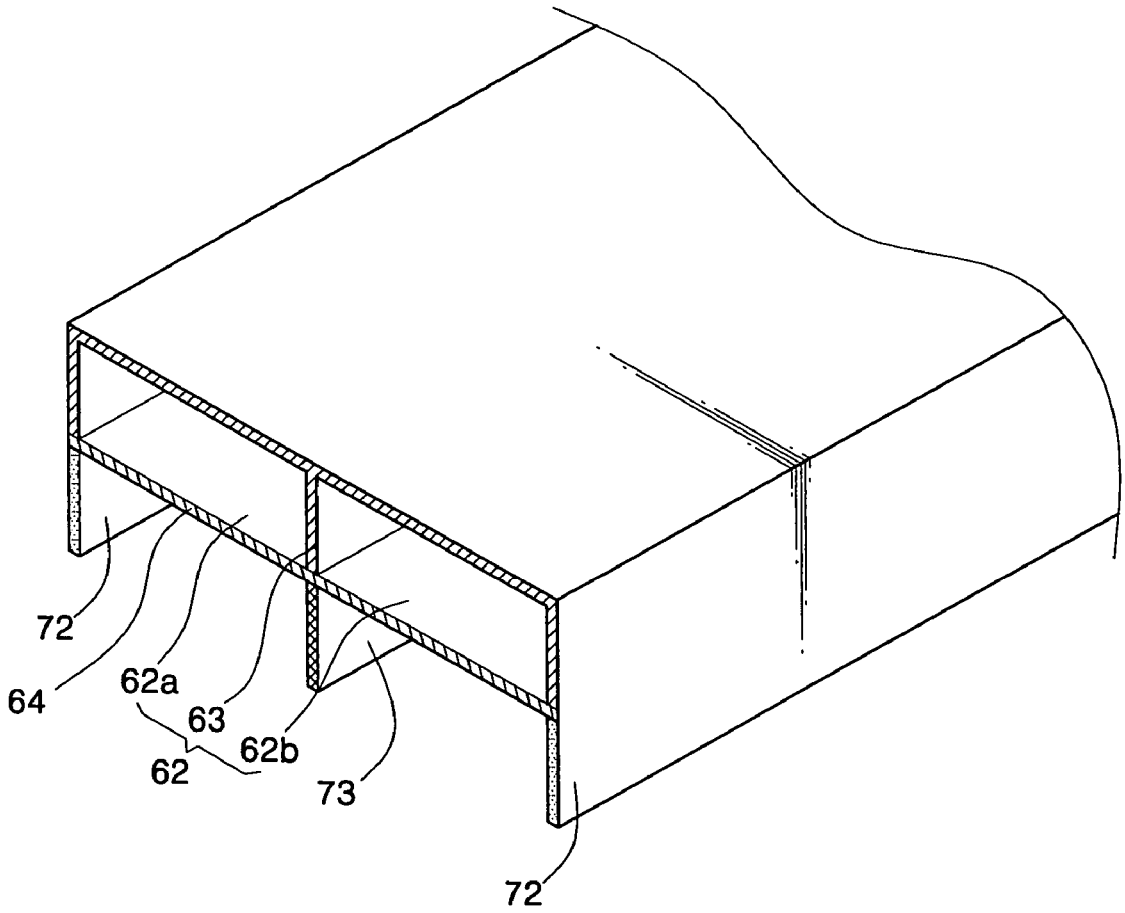
FIG. 3 is a perspective view of part of the head of a polishing pad cleaner in accordance with the present invention.
Figure 4A:
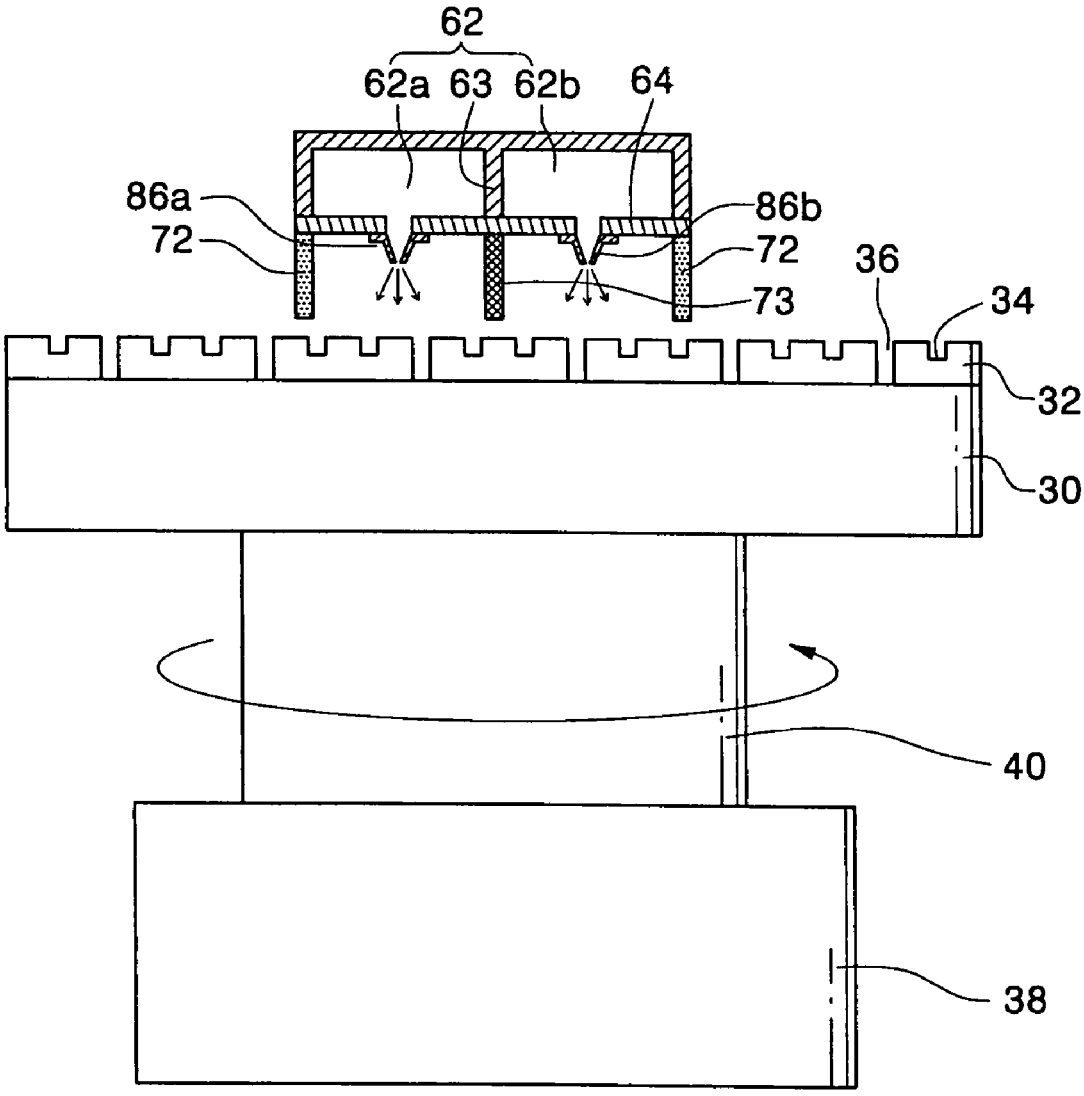
FIGS. 4A, 4B and 4C are side views, partially in section, of chemical mechanical polishing apparatus having polishing pad cleaners in accordance with the present invention.
Figure 5:
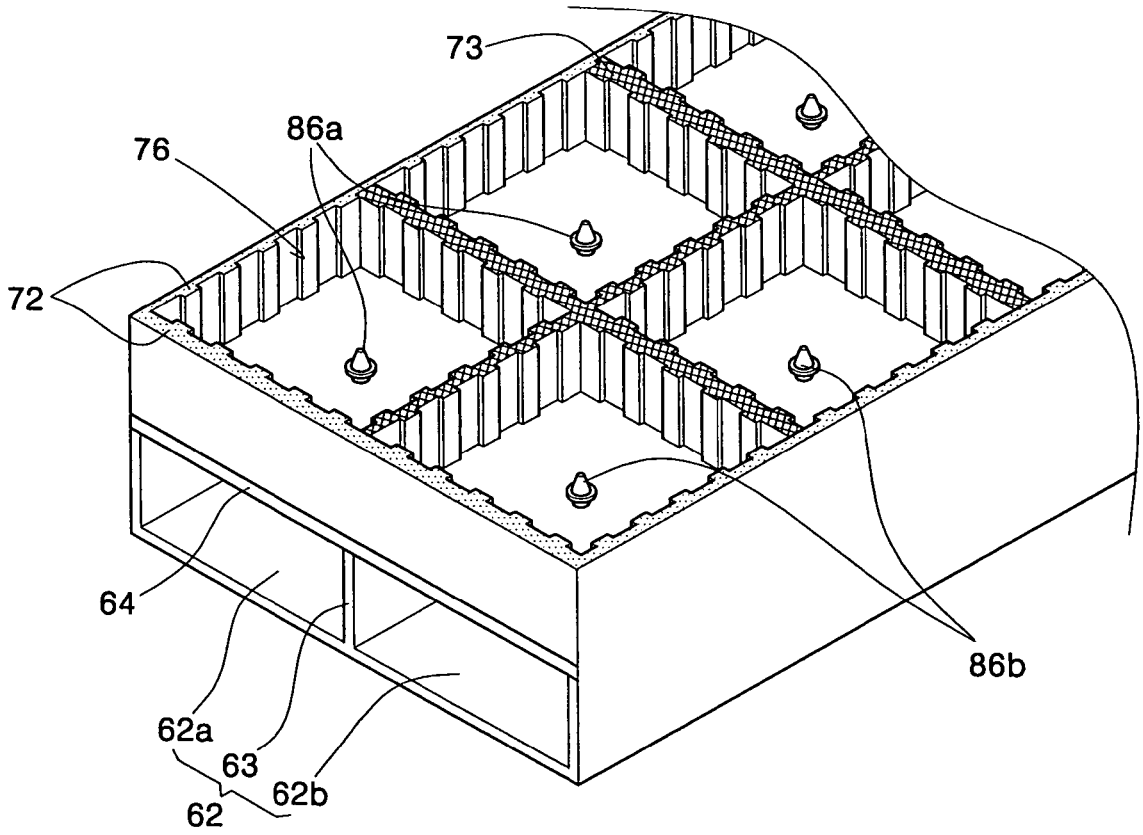
FIG. 5 is a bottom perspective view of part of the head of a polishing pad cleaner in accordance with the present invention.

Referring to FIGS. 3, 4A and 5, the polishing pad cleaner 62 may also have partitions 73 interposed between the nozzles 86 to prevent the streams of cleaning agents sprayed from adjacent ones of the nozzles 86 from interfering with one another. Therefore, the partitions 73 help maintain the specific pressure of the cleaning agents ejected from the nozzles 86.

Figure 4B:
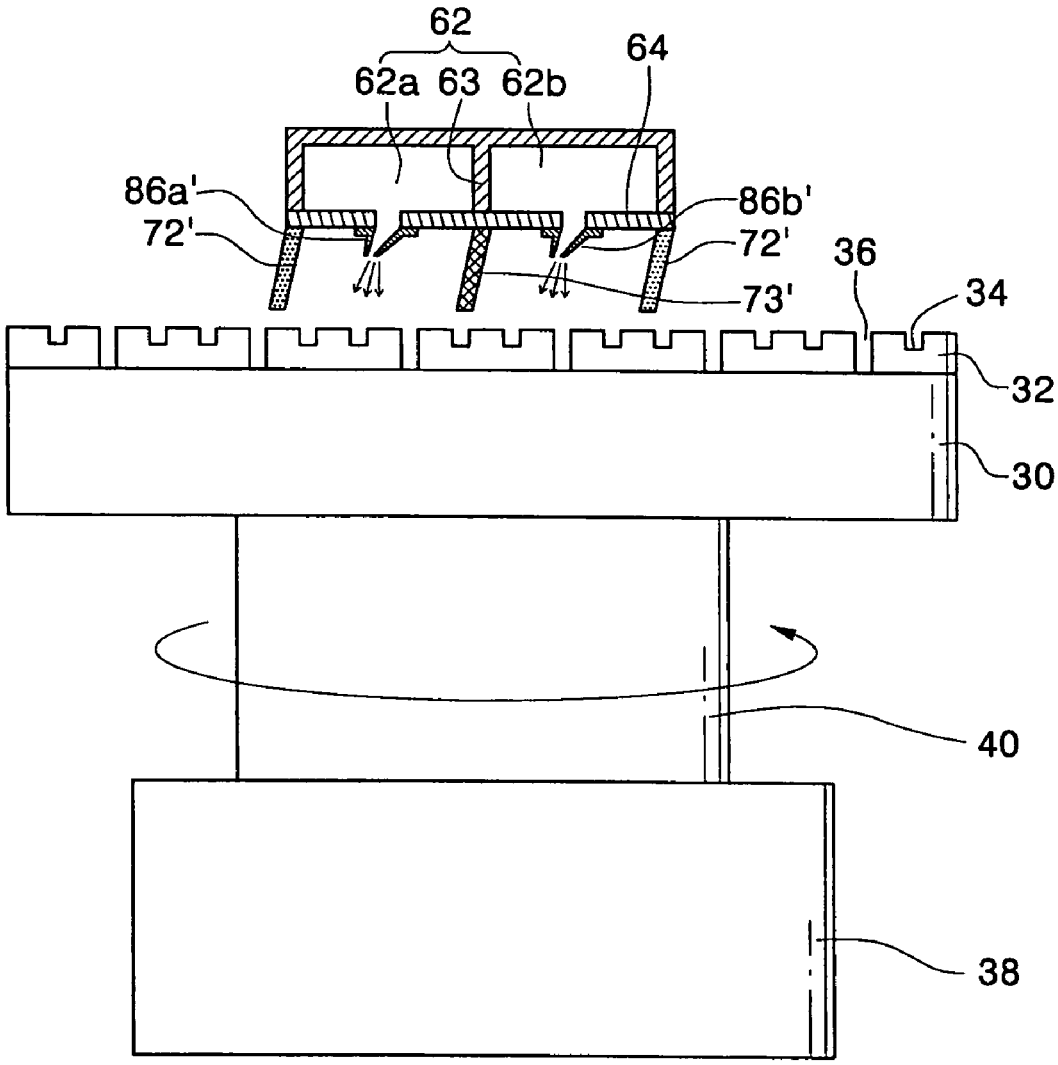

In addition, the nozzles 86 may be tilted with respect to the nozzle support plate 64 and thus, with respect to the surface of the polishing pad 32. More specifically, as shown in FIG. 4B, nozzles 86*a*' and 86*b*' may be tilted in a direction opposite to the direction in which the polishing pad 32 is rotated so that the cleaning agents ejected from the tilted nozzles 86*a*' and 86*b*' are sprayed onto the surface of the polishing pad 32 under a high pressure and along axes at an acute angle with respect to the direction of rotation of the polishing pad 32. Preferably, the spray axes of the nozzles 86*a*' and 86*b*' are inclined at an angle of 5-60° relative to the surface of the polishing pad 32, opposite to the direction of rotation of the polishing pad 32. As a result, the force at which the cleaning agent effectively acts to move material along the surface of the polishing pad 32 is relatively high. That is, cleaning agents ejected from the tilted nozzles 86*a*, 86*b* readily force the aqueous membrane and micro-debris, particles and excess slurry from the surface of the polishing pad 32.

Also, some of the partitions 73 may extend parallel to the tilted nozzles 86*a*' and 86*b*'. For example, in the case in which the cleaning agent supply chamber 62 extends in the radial direction of the polishing pad 32, the partitions 73' which extend across the direction of rotation of the polishing pad 32 are tilted so as to lie in planes parallel to the tilted nozzles 86*a*' and 86*b*'. Therefore, the streams of cleaning agent ejected along the inclined spray axes of the nozzles 86*a*' and 86*b*' at an angle are guided along the tilted partitions 73' toward the surface of the polishing pad 32.

Figure 4C:
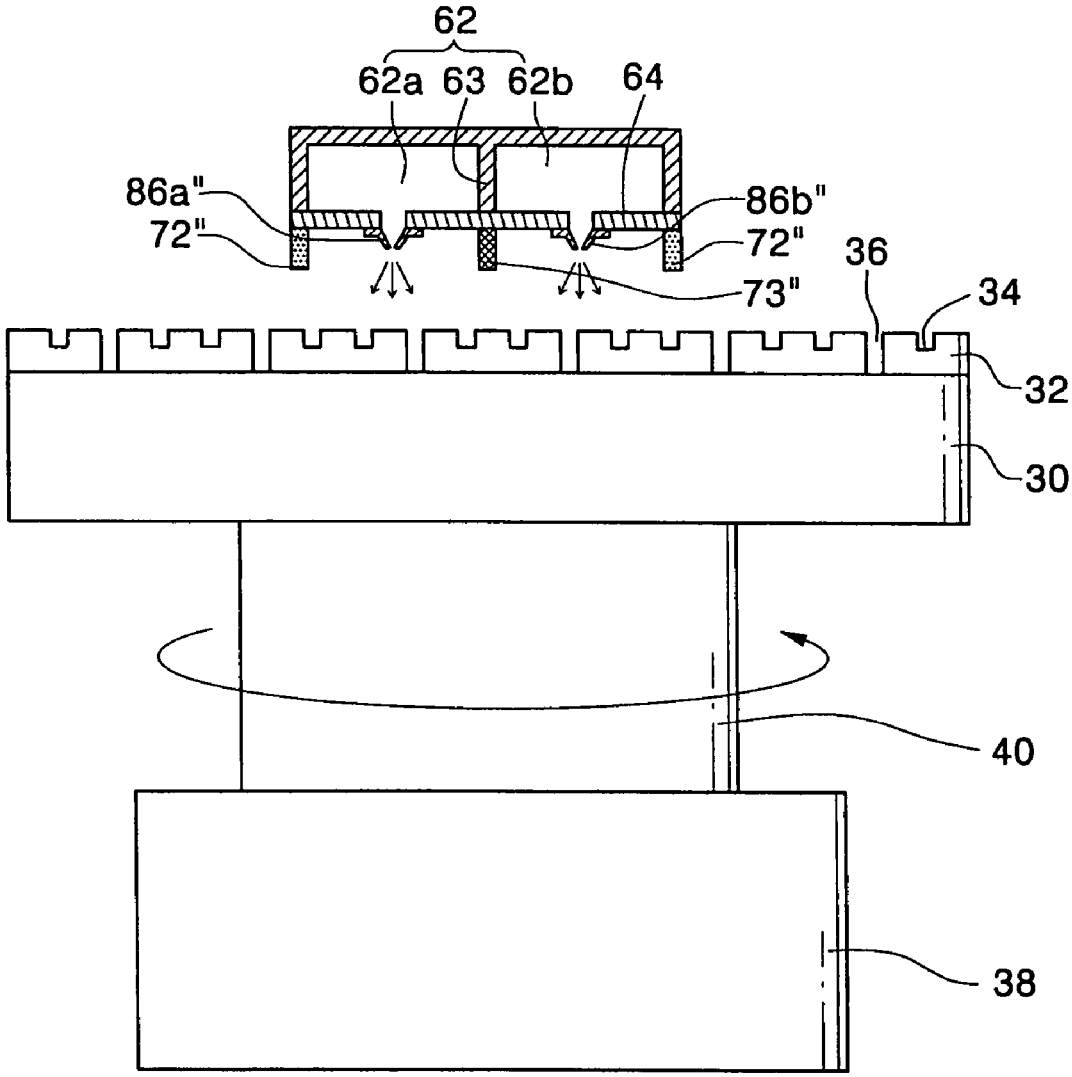

In addition, as shown in FIG. 4C, the nozzles may be tilted toward the edge of the polishing pad 32. Preferably, the spray axes of the nozzles 86*a*" and 86*b*' are inclined from the nozzle support plate 64 toward the outer peripheral edge of the polishing pad 32 at an angle of 5-60° with respect to the surface of the polishing pad 32. In this case, the cleaning agent ejected from the tilted nozzles 86*a*" and 86*b*" is directed at an angle onto the aqueous membrane and any micro-debris, particles and excess-slurry remaining on the surface of the polishing pad 32. Thus, such material is pushed by the streams of cleaning agent towards the outer peripheral edge of the polishing pad 32 and ultimately, off the edge of the polishing pad 32.

Also, some of the partitions 73" may extend parallel to the tilted nozzles 86*a*" and 86*b*". For example, in the case in which the cleaning agent supply chamber 62 extends in the radial direction of the polishing pad 32, the partitions 73" extending across the radial direction of the polishing pad 32 are tilted so as to lie in planes parallel to the tilted nozzles 86*a*" and 86*b*". Therefore, the cleaning agents ejected at an angle from the nozzles 86*a*" and 86*b*" are guided along the tilted partitions 73".

Referring back to FIGS. 3, 4A and 5, the head of the polishing cleaner 60 according to the present invention may also include sidewalls 72 extending along the periphery of the nozzle support plate 64 around the nozzles 86. Also, the sidewalls 72 (and the partitions 73) have a height larger than that of the nozzles 86. Thus, the sidewalls 72 (and partitions 73) form an enclosure(s) for the nozzles 86 with the surface of the polishing pad 32 when the sidewalls 72 (and partitions 73) are disposed adjacent to the polishing pad during a cleaning process. The enclosure(s) serves to maintain the high pressure of the cleaning agents as the agents are injected onto the surface of the polishing pad 32. That is, the cleaning agents can be forcefully ejected onto the desired region of the polishing pad 32. Thus, the sidewalls 72 (and partition 73) contribute to the high efficacy of the cleaning process.

Referring to FIG. 4B, some of the sidewalls 72' may extend parallel to the tilted nozzles 86*a*' and 86*b*'. As described above, these nozzles 86*a*' and 86*b*' are tilted in planes perpendicular to the longitudinal direction of the pad cleaner 60 and the cleaning agent supply chamber 62 extends longitudinally in the radial direction of the polishing pad 32 from the periphery to the center part of the polishing pad 32. In this case, the sidewalls 72' disposed across the direction of rotation of the polishing pad 32 lie in planes parallel to the tilted nozzles 86*a*' and 86*b*'. Therefore, the cleaning agent ejected at an angle from the tilted nozzles 86*a*' and 86*b*' is guided along the tilted sidewalls 72'.

Similarly, as shown in FIG. 4C, some of the sidewalls 72" may lie in planes parallel to the nozzles 86*a*" and 86*b*" that are tilted toward the outer peripheral edge of the polishing pad 32. That is, the sidewalls 72" extending basically perpendicular to the radial direction of the polishing pad 32 are tilted from the nozzle support plate 64 towards the outer peripheral edge of the polishing pad 32 when the cleaning agent supply chamber 60 extends longitudinally in the radial direction of the polishing pad 32. Therefore, the cleaning agent ejected at an angle from the tilted nozzles 86*a*" and 86*b*" is guided along surfaces of the tilted sidewalls 72".

Furthermore, as best shown in FIG. 5, ejection guide grooves 76 may extend in inner surfaces of the sidewalls 72 and in the surfaces of the partitions 73. The ejection guide grooves 76 extend in the directions in which the cleaning agents are ejected from the nozzles 86*a* and 86*b*. Therefore, the ejection guide grooves 76 smoothly guide outermost portions of the streams of the cleaning agents, ejected from the nozzles 86, to the polishing pad 32.

Referring now to FIGS. 2 and 3, the head of the pad cleaner 60 may be mounted to a horizontal arm member 80 of a pad cleaner transport unit. In this respect, the head of the pad cleaner 60 may be mounted to one side of the horizontal arm member 80. The horizontal arm member 80 is disposed on a vertical arm member 84. The vertical arm member 84 is, in turn, disposed on a rotatable plate 88. A rotary shaft 89 is disposed under the rotatable plate 88 and is connected thereto. The rotary shaft 89 is coupled to a motor 90 installed thereunder. Therefore, the rotatable plate 88 is driven by the motor 90. As a result, the rotatable plate 88 can rotate the vertical arm member 84 and hence, can rotate the horizontal arm member 80 and the pad cleaner 60 about the rotational axis of the rotary shaft 89.

In addition, the pad cleaner transport unit includes a horizontal transport mechanism for moving the vertical arm member 84 and hence, the horizontal arm member 80 and the head of the pad cleaner 60 horizontally. The horizontal transport mechanism includes a cylinder 91 mounted on the rotatable plate 88 and disposed horizontally. The cylinder 91 may be a hydraulic cylinder or a pneumatic cylinder. A piston rod 92 of the cylinder 91 is connected to a sidewall of the vertical arm member 84.

In addition, the rotatable plate 88 has a groove 94 extending linearly and horizontally in the upper surface thereof. The vertical arm member 84 may be seated in the groove 94 so as to be slidable along the rotatable plate 88 in the longitudinal direction of the groove 94. Thus, the vertical arm member 84, the horizontal arm member 80 and the head of the polishing pad cleaner 60 are moved horizontally when the cylinder 91 extends or retracts the piston rod 92. More specifically, the cylinder 91 extends the piston rod 92 to move the cleaning agent supply chamber 62 of the polishing pad cleaner 60 above the polishing pad 32. In addition, the cylinder 91 retracts the piston rod92 to withdraw the cleaning agent supply chamber 62 of the polishing pad cleaner 60 from the polishing pad 32 after the polishing pad cleaning process has been performed. In addition, a vertically oriented cylinder 96 may be installed under the motor 90. The piston rod 98 of the cylinder is connected to the motor 90 so as to support the motor 90. Accordingly, the cylinder 96 can raise and lower the motor 90, the rotatable plate 88 disposed on the motor 90, the vertical arm member 84 disposed on the rotatable plate 88, the horizontal arm member 80 disposed on the vertical arm member 84, and the head of the pad cleaner 60 mounted to the side of the horizontal arm member 80. Therefore, the distance between the polishing pad 32 and the nozzles 86*a* and 86*b* can be adjusted when the cleaning agent supply chamber 62 is disposed above the polishing pad 32. Thus, the force at which the cleaning agent impinges the polishing pad 32 can also be adjusted.

According to the present invention as described above, a cleaning solution and a cleaning gas can be continuously ejected onto the surface of the polishing pad such that the polishing pad is thoroughly and efficiently cleaned. In addition, the partitions between the nozzles help maintain the pressure of the cleaning agent, such as a cleaning solution and especially a cleaning gas, and thereby contribute to the effectiveness of the polishing pad cleaner of the present invention.

Finally, although the present invention has been described herein with respect to the preferred embodiments thereof, the present invention is not so limited. Also, although some specific terms have been employed in describing the present invention, such terms are used for descriptive purposes only and not for purposes of limiting the present invention. Accordingly, various changes in form and details may be made to the disclosed embodiments without departing from the true spirit and scope of the present invention as set forth in the following claims.

What is claimed is:

1. A polishing pad cleaner comprising:

a nozzle support plate;

a plurality of nozzles that spray streams of cleaning agent, respectively, the nozzles mounted to the nozzle support plate and projecting from the bottom of the nozzle support plate, whereby the nozzles have ends spaced from the bottom of the nozzle support plate and from which ends cleaning agent issues from the nozzles; and a respective partition interposed between the nozzles of each adjacent pair of the nozzles, each said partition projecting from the bottom of the nozzle support plate beyond the ends of the nozzles, wherein the plurality of nozzles include first and second groups of nozzles, and further comprising first and second reservoirs containing different types of cleaning agents disposed in communication with the first and second groups of nozzles, independently and respectively, whereby the first and second groups of nozzles eject different types of cleaning agents.

2. The polishing pad cleaner according to claim 1, wherein the first and second cleaning agent reservoirs are reservoirs of $N_2$ gas and deionized water, respectively.

3. The polishing pad cleaner according to claim 1, further comprising booster pumps disposed in-line between the first and second groups of nozzles and the first and second cleaning agent reservoirs, respectively.

4. A polishing pad cleaner comprising:

a nozzle support plate;

a plurality of nozzles that spray streams of cleaning agent, respectively, the nozzles mounted to the nozzle support plate and projecting from the bottom of the nozzle support plate, whereby the nozzles have ends spaced from the bottom of the nozzle support plate and from which ends cleaning agent issues from the nozzles; and a respective partition interposed between the nozzles of each adjacent pair of the nozzles, each said partition projecting from the bottom of the nozzle support plate beyond the ends of the nozzles, wherein each said partition has ejection guide grooves extending in outer surfaces thereof that face the adjacent pair of nozzles, respectively, the guide grooves running in directions in which cleaning agent is ejected from the nozzles.

5. A polishing pad cleaner comprising:

a nozzle support plate;

a plurality of nozzles that spray streams of cleaning agent, respectively, the nozzles mounted to the nozzle support plate and projecting from the bottom of the nozzle support plate, whereby the nozzles have ends spaced from the bottom of the nozzle support plate and from which ends cleaning agent issues from the nozzles;

a respective partition interposed between the nozzles of each adjacent pair of the nozzles, each said partition projecting from the bottom of the nozzle support plate beyond the ends of the nozzles; and sidewalls extending along the periphery of the nozzle support plate around the nozzles, wherein each of the sidewalls is inclined at the same acute angle relative to the support plate as the nozzles.

6. A polishing pad cleaner comprising:

a nozzle support plate;

a plurality of nozzles that spray streams of cleaning agent, respectively, the nozzles mounted to the nozzle support plate and projecting from the bottom of the nozzle support plate, whereby the nozzles have ends spaced from the bottom of the nozzle support plate and from which ends cleaning agent issues from the nozzles; and a respective partition interposed between the nozzles of each adjacent pair of the nozzles, each said partition projecting from the bottom of the nozzle support plate beyond the ends of the nozzles, wherein the nozzles have spray axes along which streams of fluid ejected by the nozzles are directed, respectively, and the spray axes are inclined at acute angles relative to the support plate, respectively, and wherein each said partition is inclined at the same acute angle relative to the support plate as the adjacent pair of nozzles.

7. The A polishing pad cleaner comprising:

a nozzle support plate;

a plurality of nozzles that spray streams of cleaning agent, respectively, the nozzles mounted to the nozzle support plate and projecting from the bottom of the nozzle support plate, whereby the nozzles have ends spaced from the bottom of the nozzle support plate and from which ends cleaning agent issues from the nozzles;

a respective partition interposed between the nozzles of each adjacent pair of the nozzles, each said partition projecting from the bottom of the nozzle support plate beyond the ends of the nozzles; and sidewalls extending along the periphery of the nozzle support plate around the nozzles, wherein the sidewalls have ejection guide grooves extending in inner surfaces thereof that face towards the nozzles, the guide grooves running in directions in which cleaning agent is ejected from the nozzles.

8. A polishing pad cleaner comprising:

a nozzle support plate;

first and second groups of nozzles mounted to the nozzle support plate and projecting from the bottom of the nozzle support plate;

first and second reservoirs containing different types of cleaning agents disposed in communication with the first and second groups of nozzles, independently and respectively, whereby the first and second groups of nozzles eject different types of cleaning agents; and a respective partition interposed between the nozzles of each adjacent pair of the nozzles.

9. The polishing pad cleaner according to claim 8, wherein the first and second cleaning agent reservoirs are reservoirs of $N_2$ gas and deionized water, respectively.

10. The polishing pad cleaner according to claim 8, further comprising booster pumps disposed in-line between the first and second groups of nozzles and the first and second cleaning agent reservoirs, respectively.

* * * * *